US009101846B2

(12) United States Patent
Chan

(10) Patent No.: US 9,101,846 B2
(45) Date of Patent: Aug. 11, 2015

(54) DOLL WITH RECONFIGURABLE GARMENT PORTION

(75) Inventor: Patricia Chan, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 845 days.

(21) Appl. No.: 12/869,939

(22) Filed: Aug. 27, 2010

(65) Prior Publication Data

US 2012/0052764 A1 Mar. 1, 2012

(51) Int. Cl.

| | |
|---|---|
| ***A63H 3/52*** | (2006.01) |
| ***A63H 3/00*** | (2006.01) |
| ***A63H 3/20*** | (2006.01) |
| ***A63H 33/00*** | (2006.01) |

(52) U.S. Cl.

CPC .. *A63H 3/52* (2013.01); *A63H 3/00* (2013.01); *A63H 3/20* (2013.01); *A63H 33/003* (2013.01)

(58) Field of Classification Search

USPC ..... 446/98, 268, 319, 321, 330, 490, 74, 446/14, 72, 331; D21/627

See application file for complete search history.

(56) References Cited

U.S. PATENT DOCUMENTS

| | | | | |
|---|---|---|---|---|
| 1,567,661 | A | 12/1925 | Levaggi et al. | |
| 2,143,294 | A | 1/1939 | Whiting | |
| 2,582,699 | A | 1/1952 | Jelaso et al. | |
| 3,175,327 | A | 3/1965 | Wend | |
| 3,696,552 | A | 10/1972 | Gunther et al. | |
| 3,828,467 | A * | 8/1974 | Kaelin | 446/320 |
| 4,499,678 | A | 2/1985 | Moreau | |
| 4,685,893 | A | 8/1987 | Perkitny et al. | |
| 5,116,277 | A | 5/1992 | Kelley | |
| 5,320,573 | A | 6/1994 | Matsuyama | |
| 5,624,320 | A | 4/1997 | Martinez | |
| 5,957,745 | A | 9/1999 | Johnson et al. | |
| 7,318,766 | B2 | 1/2008 | Marine et al. | |
| 2006/0270307 | A1 | 11/2006 | Montalvo et al. | |
| 2008/0173686 | A1 * | 7/2008 | Kennedy | 224/600 |
| 2009/0075555 | A1 * | 3/2009 | Barthold | 446/330 |
| 2009/0253347 | A1 * | 10/2009 | Byrd | 446/321 |
| 2010/0041301 | A1 | 2/2010 | Phillips | |
| 2010/0093254 | A1 | 4/2010 | Jung | |

FOREIGN PATENT DOCUMENTS

| | | | |
|---|---|---|---|
| CA | 2740429 | A1 | 4/2010 |
| EP | 0327487 | A1 | 8/1989 |
| JP | 60-43290 | U | 3/1985 |
| JP | 2095390 | A | 4/1990 |

OTHER PUBLICATIONS

Extended European Search Report for EP Application No. 11178575.4, dated Dec. 6, 2011, 8 pages.

Barbie Movie Star instructions, 3 pages, © 2003.

Second Office Action from the State Intellectual Property Office of the People's Republic of China regarding Chinese Application No. 2011103531422, mailed Jun. 13, 2014.

* cited by examiner

*Primary Examiner* — John E Simms, Jr.

(74) *Attorney, Agent, or Firm* — Edell, Shapiro & Finnan, LLC

(57) ABSTRACT

A reconfigurable doll includes a body having a torso defining a cavity, and a garment member coupled to the body. The garment member is movable between an extended position extending outwardly from the torso, and a retracted position substantially disposed within the cavity.

18 Claims, 7 Drawing Sheets

DOLL WITH RECONFIGURABLE GARMENT PORTION

FIELD OF THE INVENTION

The present invention relates to doll, and in particular, to a doll including a garment member movable between an extended position and a retracted position disposed within a cavity defined by the doll.

BACKGROUND OF THE INVENTION

Various dolls with clothing and accessories are known. Some dolls include removable clothing or accessories, such as shoes or purses, so that the dolls outfits may be selected and changed by a child. However, such conventional dolls provide limited possibilities for reconfiguring the appearance of the doll.

There is a need for a doll having a unique mechanism for reconfiguring its appearance, which is relatively simple to operate, and which retains a child's interest and imagination.

SUMMARY OF THE INVENTION

The present invention is directed to a reconfigurable doll including a body having a torso defining a cavity. A garment member is coupled to the body. The garment member is movable between an extended position extending outwardly from the torso, and a retracted position substantially disposed within the cavity.

In one embodiment, the garment member has a first length in the extended position and a second length in the retracted position. The second length is less than the first length.

In one embodiment, the garment member is a first garment member, and the reconfigurable doll further includes a second garment member coupled to the body. The second garment member is substantially covered by the first garment member when the first garment member is in its extended position. The second garment member is exposed when the first garment member is in its retracted position.

In one embodiment, the garment member is linearly movable in opposing first and second directions. The opposing first and second directions are substantially parallel to a longitudinal axis of the torso.

In one embodiment, the reconfigurable doll further includes a wing assembly coupled to the torso. The wing assembly is movable between a raised position and a lowered position relative to the torso. In one implementation, the wing assembly includes a first wing member and a second wing member. In one implementation, the garment member is configured as a portion of a dress when the garment member is disposed in its extended position, and the wing assembly is configured as a dress train when the wing assembly is disposed in its lowered position.

In one embodiment, the reconfigurable doll includes an elongate member having a first end portion connected to the garment member and second end portion extending through an opening in the torso. The second end portion is movable away from the opening to move the garment member from its extended position to its retracted position.

The present invention is also directed to a reconfigurable doll including a body having a torso defining a cavity. A first opening is disposed in the torso and in communication with the cavity, and a second opening is disposed in the torso and in communication with the cavity. A garment member is coupled to the body and extends outwardly from the first opening. An extension member has a first end portion coupled to the garment member and an opposing second end portion extending outwardly from the second opening. At least a portion of the garment member is retractable into the cavity through the first opening as the second end portion of the extension member is moved away from the second opening in the torso.

In one embodiment, the garment member is a first garment member, and the doll further includes a second garment member coupled to the body. The second garment member is substantially covered by the first garment member when the portion of the first garment member is extending outwardly from the first opening. The second garment member is exposed when the portion of the first garment member is retracted into the cavity.

The present invention is also directed to a reconfigurable doll including a body having a torso, and a garment member coupled to the body. The garment member has a distal portion, the distal portion being movable between a retracted position proximate the torso and an extended position spaced from the torso. A movement member is coupled to the body. The movement member is movable between a raised position and a lowered position relative to the torso. The movement member forms a wing structure in the raised position. The movement member forms a dress train in the lowered position.

In one embodiment, the reconfigurable doll includes a support member coupled to the body. The support member is connected to the movement member, and includes an actuator or switch that is manipulatable by a user to move the movement member between its raised position and its lowered position.

In one embodiment, the garment member is linearly movable in opposing first and second directions, the opposing first and second directions being substantially parallel to a longitudinal axis of the torso. In one implementation, the movement member includes a first wing member and a second wing member. The first and second wing members are pivotal about an axis substantially perpendicular to the first and second directions.

BRIEF DESCRIPTION OF THE DRAWINGS

Like reference numerals have been used to identify like elements throughout this disclosure.

DETAILED DESCRIPTION OF THE INVENTION

The terms "garment portion" and "garment member" are used interchangeably herein to refer to a structure that resembles a garment or article of clothing.

Figure 1:
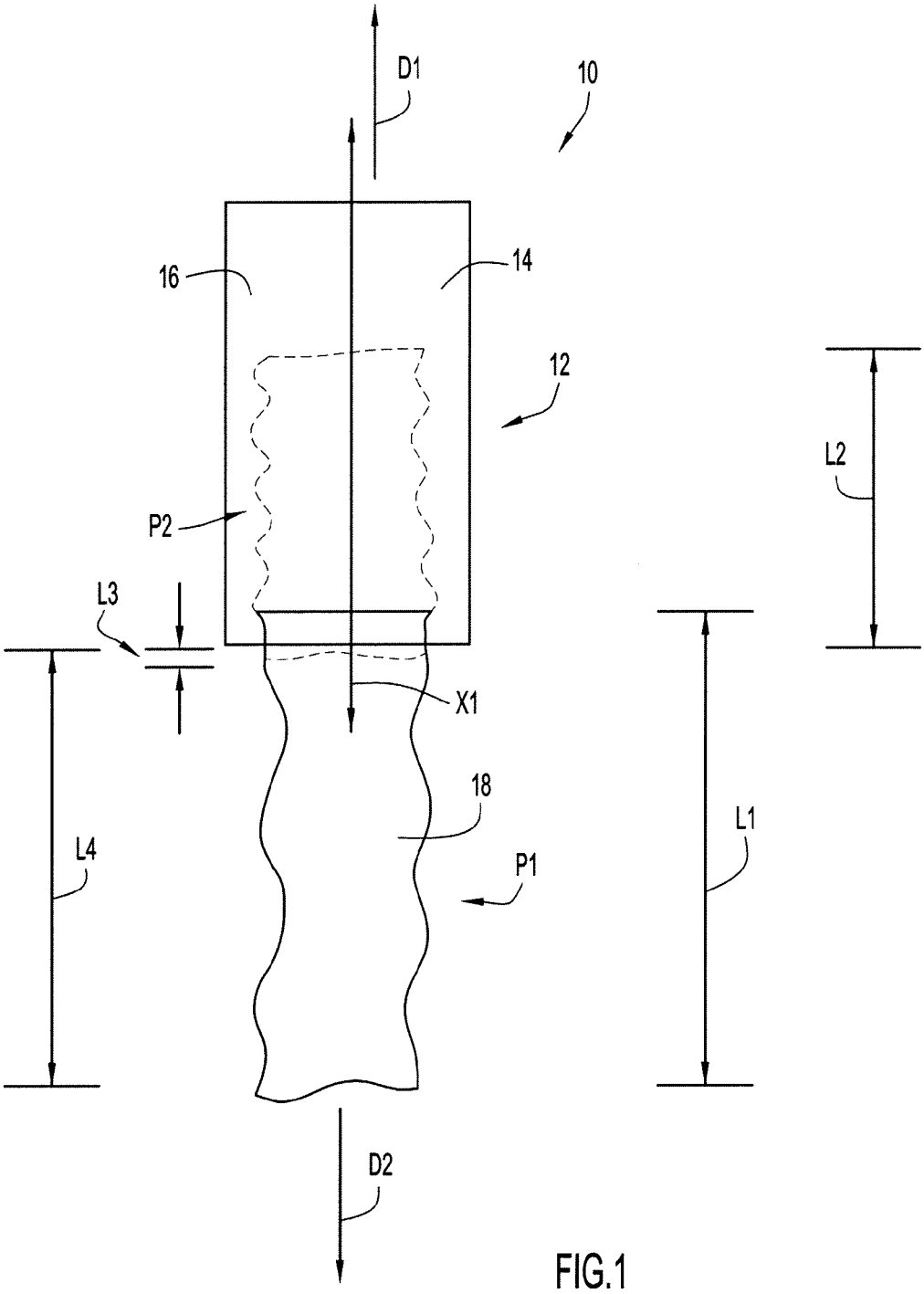
FIG. 1 illustrates a schematic diagram of a reconfigurable doll according to an embodiment the present invention.

FIG. 1 illustrates a schematic diagram of a reconfigurable doll 10 according to an embodiment of the present invention. The doll 10 includes a body 12 having a torso 14 defining a cavity 16. A garment member 18 is coupled to the body 12. The garment member 18 is movable between an extended position P1 extending outwardly from the torso 14, and retracted position P2 (shown in phantom) substantially disposed within the cavity 16. In the retracted position P2, all or essentially all of the garment member 18 is located in the cavity 16. As a result, the garment member 18 of the doll 10 has a different configuration and the doll 10 has a different appearance depending on the position P1 or P2 in which the garment member 18 is placed.

In one embodiment, the garment member 18 is formed from a flexible material, such as a synthetic or natural fabric material, which folds or crumples when the garment member 18 is moved to its retracted position P2 within the cavity 16. Accordingly, the garment member 18 has a first length L1 when disposed in its extended position P1 and a second length L2 when disposed in its retracted position P2. In this embodiment, the second length L2 is less than the first length L1. The difference in lengths is due to the garment member 18 bunching up or folding.

The garment member 18 is movable in a direction D1 from its extended position P1 to its retracted position P2, and in an opposing direction D2 from its retracted position P2 back to its extended position P1. In one implementation, directions D1, D2 are substantially parallel to a longitudinal axis X1 of the torso 14. Thus, the garment member 18 may be reconfigured between its extended position P1 and its retracted position P2, thereby covering or exposing appendages or other garments or accessories of the doll 10. In addition, in this embodiment, the extent to which the garment member 18 extends varies between an extended length L4 and a retracted length L3. These lengths L3 and L4 correspond to the amount of the garment portion or member 18 that extends from the doll 10 in the different configurations.

A reconfigurable doll 100 according to another embodiment is illustrated in FIGS. 2-6. In this embodiment, the doll 100 includes a body 102 having a torso 104, arms 106, 108, legs 110, 112, and a head 114. Coupled to the body 102 of the doll 100 is a garment member 128. The garment member 128 extends outwardly from an opening that is located near the bottom end of the torso 104. In one implementation, the garment member 128 is configured to resemble a dress or skirt. The garment member 128 has a proximal end portion 130, an opposing distal end portion 132, and a central portion 134 therebetween.

Figure 6:
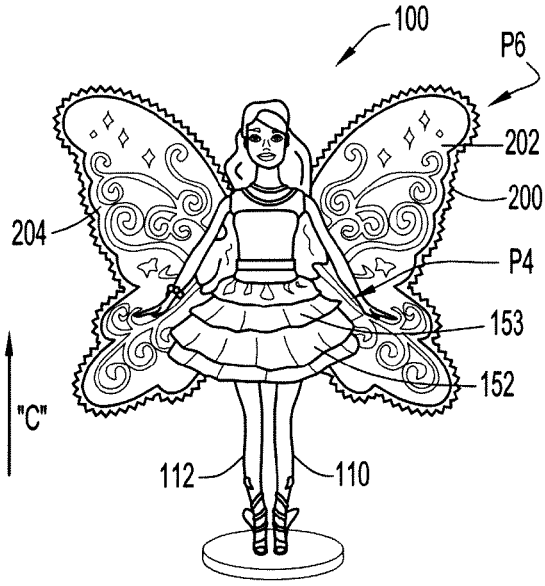
FIG. 6 illustrates a front view of the reconfigurable doll of FIG. 5.

As shown, the garment member 128 can be placed into several different positions or configurations, including an extended position or configuration P3 (see FIG. 2), an intermediate position or configuration P3A (see FIG. 4), and a retracted position or configuration P4 (see FIG. 6). As described below, an actuator assembly 136 (see FIG. 3) extends from the doll 100 and can be manipulated by a user. When the actuator assembly 136 is pulled along the direction of arrow "A," the garment member 128 moves and is reconfigured from configuration P3 to configuration P3A along the direction of arrow "B" in FIG. 4 and to configuration P4 along the direction of arrow "C" in FIG. 6.

The doll 100 also includes a wing assembly 200 that has wing portions or members 202 and 204 movably coupled to the body 102 of the doll 100. The wing assembly 200, including its wing portions 202 and 204, is movable between its lowered position or configuration P5 (see FIG. 3) and its raised position or configuration P6 (see FIG. 6). The wing assembly 200 can be moved by a user by manipulating an actuator on the doll 100.

Figure 7:
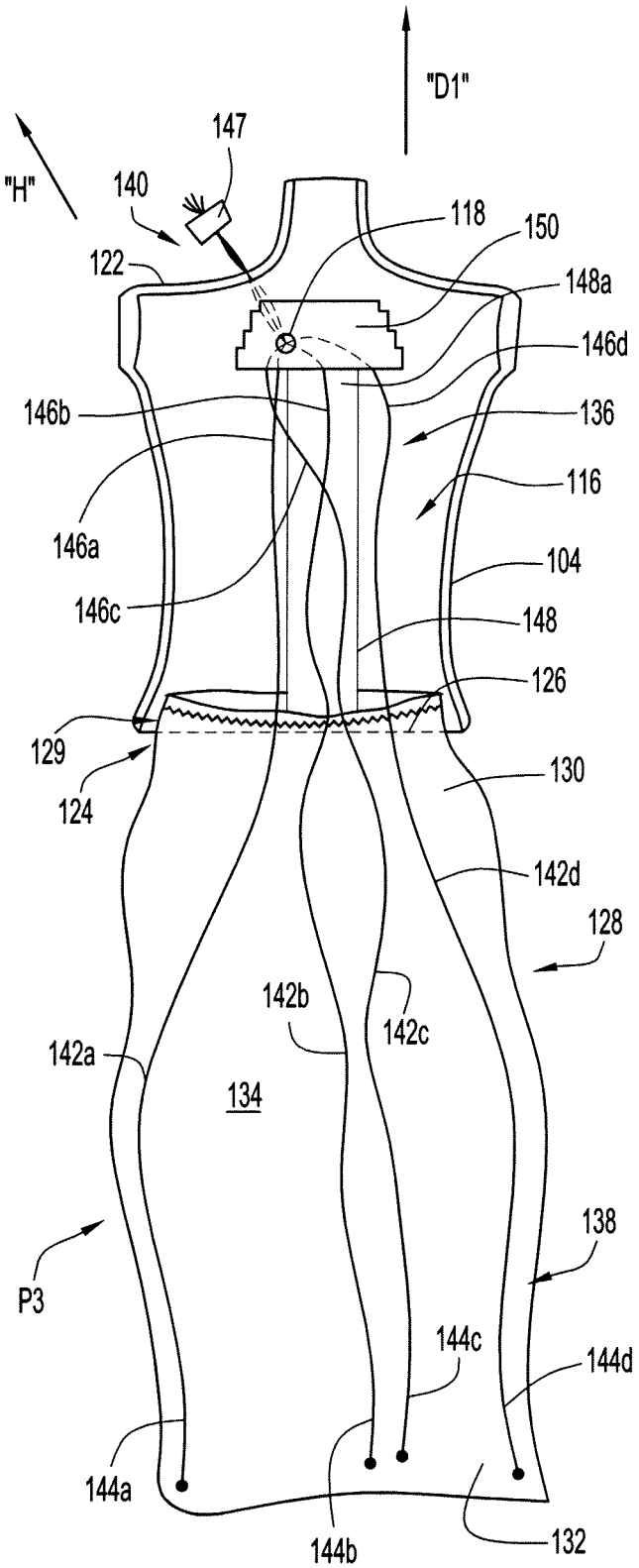
FIG. 7 illustrates a partial sectional view of some components of the torso of the reconfigurable doll of FIG. 2, showing the garment member in an extended position.

Referring to FIG. 7, a partial sectional view of the torso 104 is illustrated. In this view, the front portion of the torso is removed so that some internal components can be viewed. In addition, the lower body portion (including the legs of the doll) is not illustrated for ease of reference.

In this embodiment, the torso 104 defines a cavity 116 and an opening 118 that is in communication with the cavity 116. In one embodiment, the opening 118 is formed in a back portion 120 (shown in FIG. 9) of the torso 104 proximate an upper end portion 122 thereof. Referring again to FIG. 7, another opening 124 is formed in the torso 104 and in communication with the cavity 116. The opening 124 is formed in a lower end portion 126 of the torso 104 opposite the upper end portion 122, and spaced from the opening 118. In this embodiment, the garment member 128 is generally tubular along its length and the upper or proximal end 130 is inserted into the opening or receptacle 124 that is generally circular and located around the perimeter of the lower end of the torso 104.

With continued reference to FIG. 7, an actuator assembly 136 has a lower end portion 138 and an opposing upper end portion 140. In one implementation, the actuator assembly 136 includes a plurality of elongate members, such as flexible cords or strings. For example, the actuator assembly 136 may include elongate members or cords 142*a*, 142*b*, 142*c*, 142*d* including lower end portions 144*a*, 144*b*, 144*c*, 144*d*, respectively, which are coupled to the distal end portion 132 of the garment member 128. The elongate members 142*a*, 142*b*, 142*c*, 142*d* include upper end portions 146*a*, 146*b*, 146*c*, 146*d*, respectively, which extend outwardly from the opening 118 proximate the upper end portion 122 of the torso 104. In one embodiment, the upper end portions 146*a*, 146*b*, 146*c*, 146*d* are coupled together via a pull tab 147 graspable by a user.

In this embodiment, the proximal end portion 130 includes an elastic portion 129 that contains one or more elastic members that are sewn to the garment member 128 to narrow the upper opening of the garment member 128. The elastic portion 129 can be used to maintain the generally circular configuration of the upper or proximal end 130 of the garment member 128.

The proximal end portion 130 and at least a portion of the central portion 134 of the garment member 128 are pulled through the opening 124 and retracted into the cavity 116 of the torso 104 as the upper end portion 140 of the actuator assembly 136 (e.g. upper ends 146*a*, 146*b*, 146*c*, 146*d* of cords 142*a*, 142*b*, 142*c*, 142*d*) is moved away from the opening 118 in the torso 104. For example, the user may grasp and pull the pull tab 147 outwardly and/or upwardly and away from the opening 118 along the direction of arrow "H," thereby raising the garment member 128 upwardly and into the cavity 116. In one embodiment, the garment member 128 is retained in its upper position or configuration by friction between the garment member 128 and the inner surface of the wall defining the torso. In addition or alternatively, the garment member 128 is retained in its upper position or configuration by tension applied to the garment member 128 by the elongate members.

Figure 8:
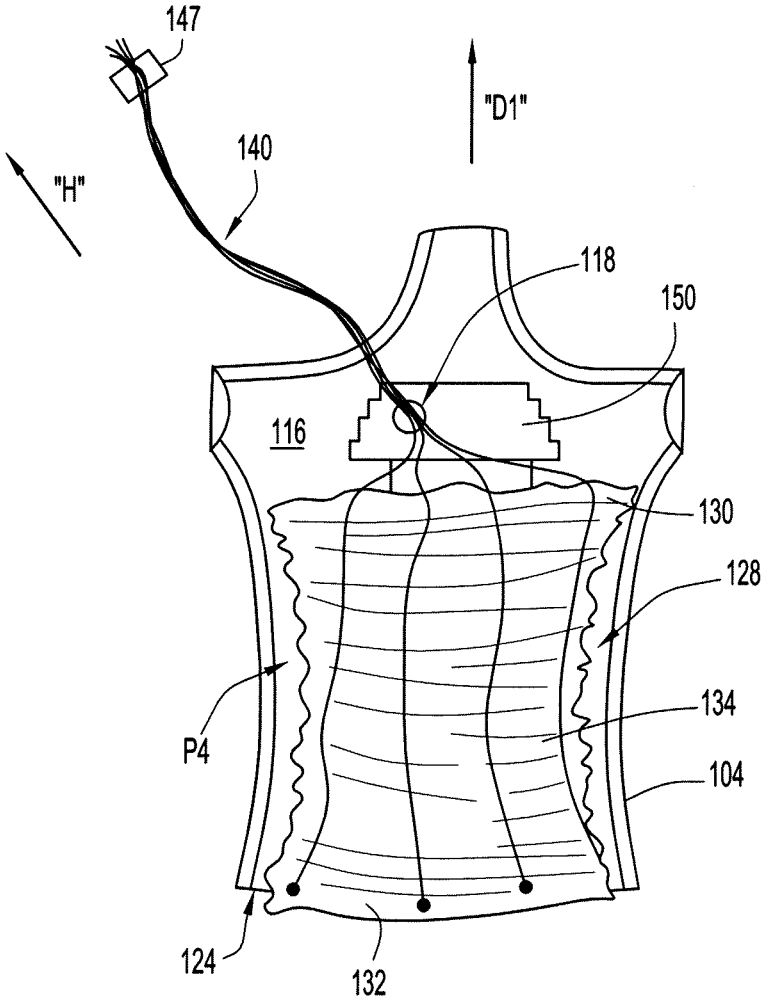
FIG. 8 illustrates a partial sectional view of the torso of FIG. 7, showing the garment member in a retracted position.

In one implementation, the garment member 128 is formed from a flexible fabric material, so that the central portion 134 folds or crumples as the garment member 128 is retracted from an extended position P3 (shown in FIG. 7) to a retracted position P4 (shown in FIG. 8) within the torso 104. Thus, the distal end portion 132 of the garment member 128 is movable between a position spaced from the torso 104 when the garment member 128 is in its extended position P3, and a position proximate to the torso 104 when the garment member 128 is in its retracted position P4.

With continued reference to FIG. 7, the actuator assembly 136 includes a guide post or column 148 that is coupled to the torso 104 and disposed within the cavity 116. The guide post 148 includes a longitudinal axis coaxial with and/or parallel to the longitudinal axis X1 of the torso 104. The garment member 128 encircles the guide post 148 and is slidably movable and positionable therealong. The proximal end portion 130 of the garment member 128 is maintained around and along the guide post 148 as the garment member 128 moves between its extended position P3 and its retracted position P4. Thus, the guide post 148 ensures that the garment member 128 is properly channeled or aligned and compressed into the cavity 116 when moved to its retracted position P4.

In one embodiment, an end cap 150 is coupled to an upper end 148*a* of the guide post 148. The end cap 150 includes guides or openings through which the cords 142*a*, 142*b*, 142*c*, 142*d* pass. The cords 142*a*, 142*b*, 142*c*, 142*d* are thereby aligned with the opening 118 in the torso 104, and exert an upwardly directed force (e.g. in direction D1) parallel to the longitudinal axis X1 of the torso 104 when the upper ends 146*a*, 146*b*, 146*c*, 146*d* of cords 142*a*, 142*b*, 142*c*, 142*d* are pulled outwardly and away from the opening 118 in the torso 104. In this way, the possibility of tangling or misalignment of the cords 142*a*, 142*b*, 142*c*, 142*d* within the cavity 116 is minimized, and the garment member 128 may be easily moved to its retracted position P4.

Figure 2:
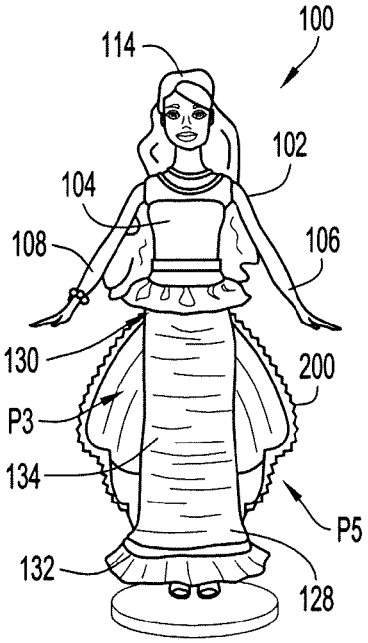
FIG. 2 illustrates a front view of a reconfigurable doll according to another embodiment, showing a garment member in an extended position and a wing assembly in a lowered position.
Figure 3:
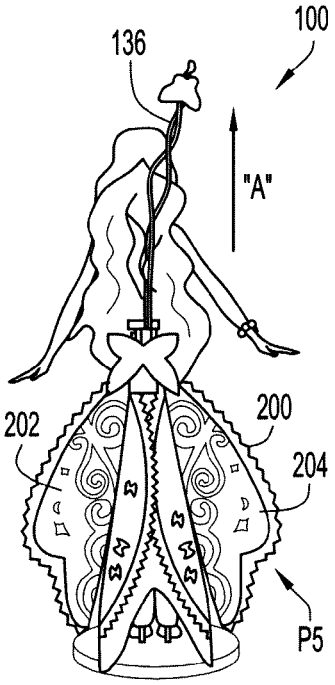
FIG. 3 illustrates a rear view of the reconfigurable doll of FIG. 2.
Figure 4:
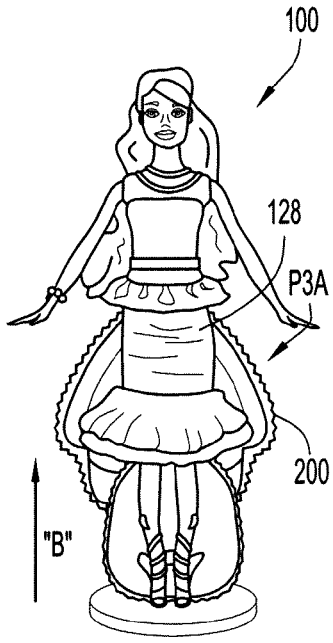
FIG. 4 illustrates a front view of the reconfigurable doll of FIG. 2 with its garment member in an intermediate position.
Figure 5:
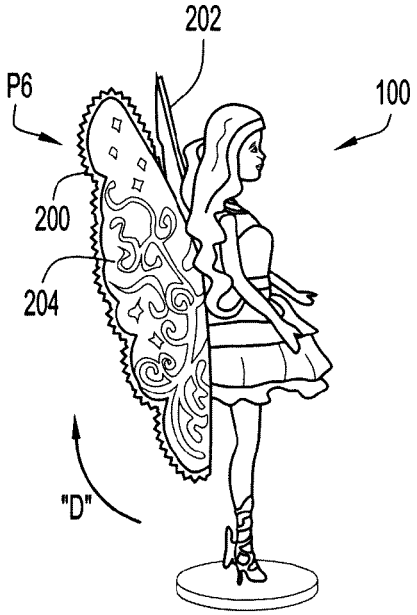
FIG. 5 illustrates a side view of the reconfigurable doll of FIG. 2 with its garment member in a retracted position and its wing assembly in a raised position.

Referring again to FIG. 6, in one embodiment, a secondary garment member 152 is coupled to the torso 104. The secondary garment member 152 is substantially covered by the garment member 128 when the central portion 134 of the garment member 128 is disposed in its fully extended position P3, as shown in FIG. 2. The secondary garment member 152 is exposed when the garment member 128 is disposed in its retracted position P4 within the cavity 116 in the torso 104, as shown in FIG. 6.

In one embodiment, an upper portion 153 of the secondary garment member 152 is coupled to the distal end portion 132 of the garment member 128. Thus, as the garment member 128 is moved upwardly through its intermediate position P3A toward its retracted position P4, it pulls the secondary garment member 152 upwardly along the legs 110, 112 of the doll 100 and toward the torso 104. The garment member 128 is pulled into the cavity 116 when in its retracted position P4, thereby leaving the secondary garment member 152 exposed, as shown in FIG. 6. The secondary garment member 152 may be configured to resemble a shorter dress or skirt (relative to the garment member 128). Thus, the doll 100 may be reconfigured between a first mode including a relatively long and elegant dress, as shown in FIG. 2, and a relatively short and less formal skirt, as shown in FIG. 6.

In one embodiment, the doll 100 includes a wing assembly 200 coupleable to the torso 104. The wing assembly 200 is movable between a lowered position P5 (shown in FIG. 2) and a raised position P6 (shown in FIG. 6) relative to the torso 104. As noted above, the garment member 128 may be configured as a dress when disposed in its extended position P3. In one implementation, the wing assembly 200 is configured to resemble a dress train or additional portion or accessory to the garment member 128 when the wing assembly 200 is disposed in its lowered position P5, thereby complementing the garment member 128 as a portion of the dress.

Figure 9:
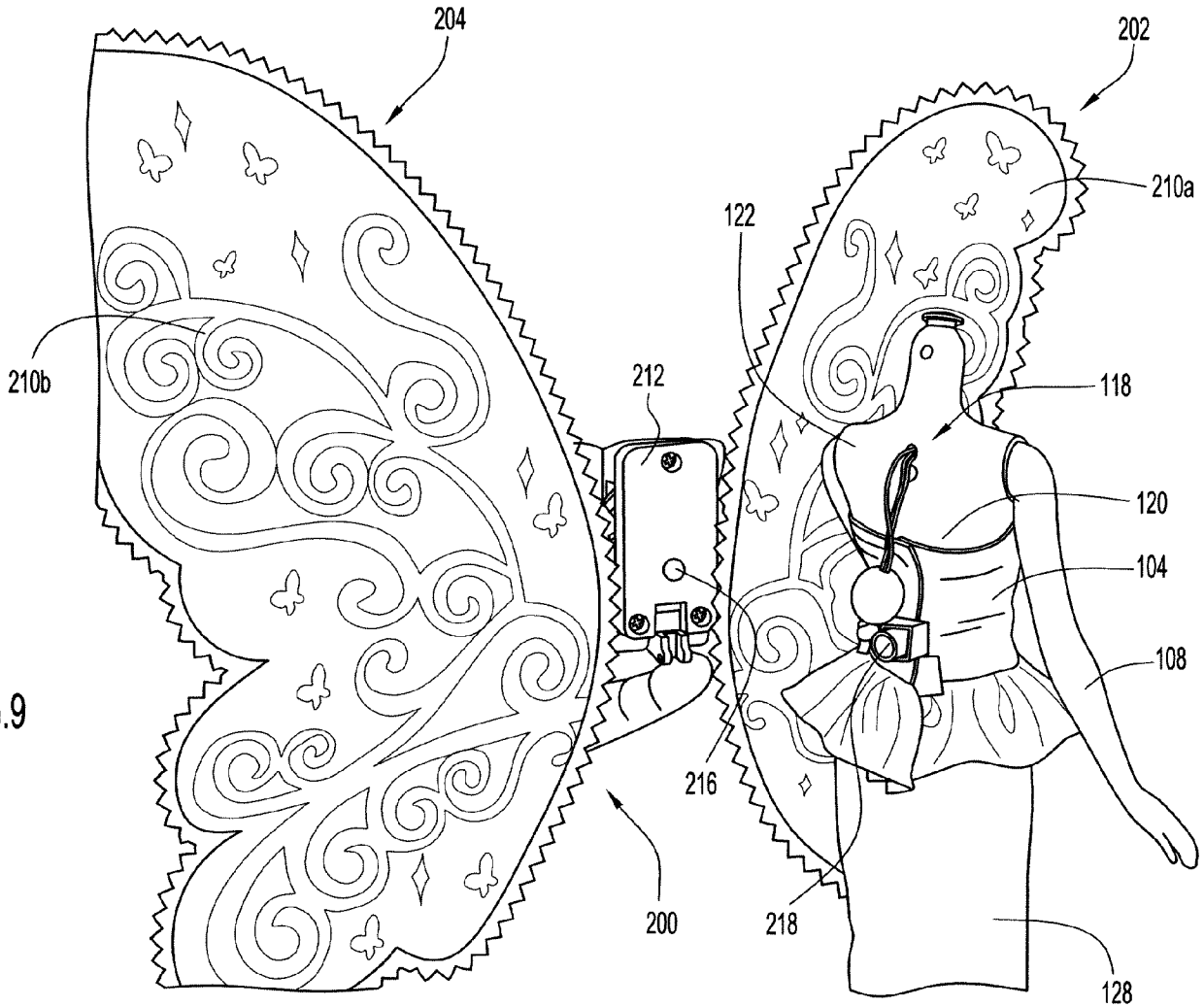
FIG. 9 illustrates a rear perspective view of portions of the reconfigurable doll of FIG. 2, showing the wing assembly decoupled from the body of the doll.

Referring to FIG. 9, the wing assembly 200 includes a pair of movement members, or wing members 202, 204. The wing members 202, 204 are configured to simulate a pair of wings when the wing assembly 200 is disposed in its raised position P6.

Figure 11:
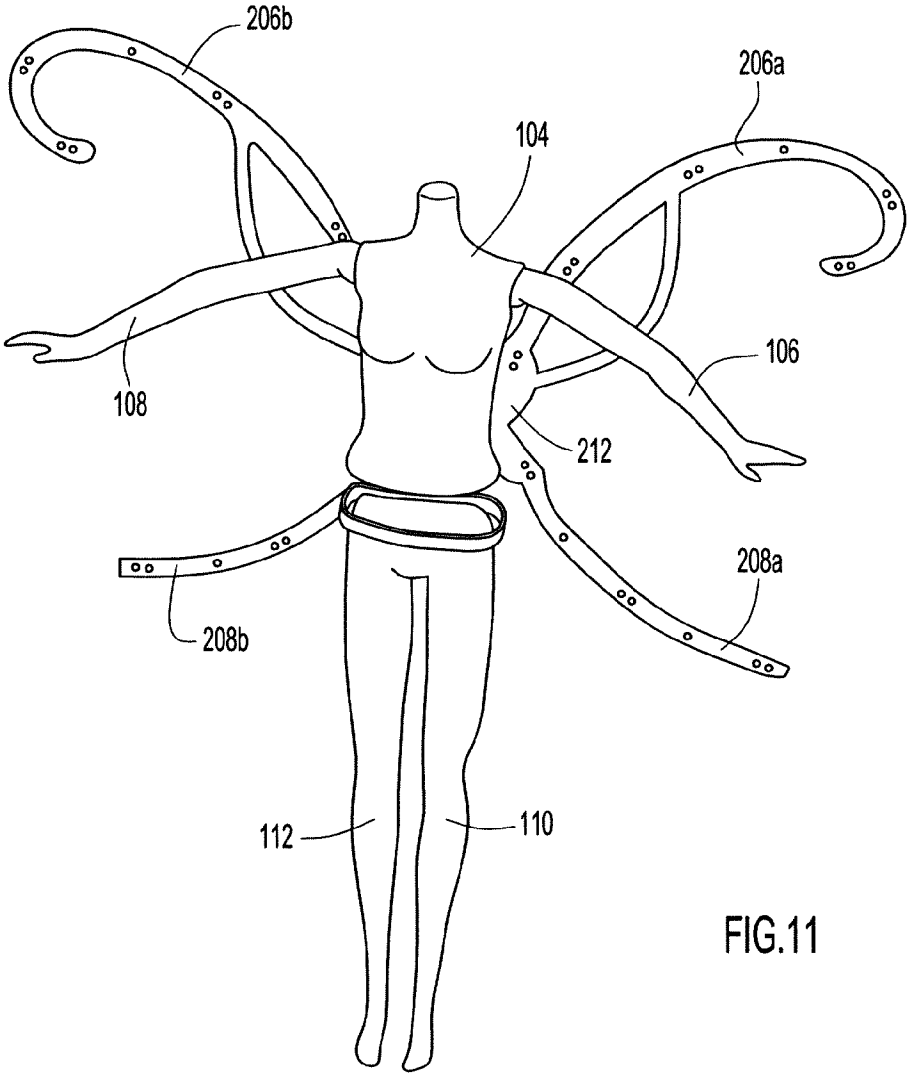
FIG. 11 illustrates a front perspective view of some components of the reconfigurable doll of FIG. 2.

Referring to FIGS. 9 and 11, wing member 202 includes an upper support arm 206*a* and a lower support arm 208*a* (shown in FIG. 11). A flexible sheet 210*a* (shown in FIG. 9) is coupled to and extends between the upper support arm 206*a* and the lower support arm 208*a*. The upper support arm 206*a* and the lower support arm 208*a* are pivotally coupled to a support member 212. In one embodiment, the support member 212 includes an actuator or switch that is manipulatable by a user to move the wing member 202 between its raised position P6 and its lowered position P5.

Similarly, wing member 204 includes an upper support arm 206*b* and a lower support arm 208*b* (shown in FIG. 11). Another flexible sheet 210*b* is coupled to and extends between the upper support arm 206*b* and the lower support arm 208*b* (shown in FIG. 9). The upper support arm 206*b* and the lower support arm 208*b* are pivotally coupled to the support member 212.

Actuation of the switch via user manipulation simultaneously moves wing members 202, 204 between their raised position P6 (as shown in FIG. 6) and their lowered position P5 (as shown in FIG. 2). For example, in one embodiment, linear movement of the switch causes pivotal movement of the upper support arms 206*a*, 206*b* via meshed gears (e.g. a toothed slide coupled to the switch 214 and gears connected to the ends of the upper support arms 206*a*, 206*b*). The upper support arms 206*a*, 206*b* may be pivoted upwardly, thereby moving the wing members 202, 204 toward their raised position P6. As the upper support arms 206*a*, 206*b* move toward the raised position P6, the flexible sheets 210*a*, 210*b* are pulled taut. Once relatively taut, the flexible sheets 210*a*, 210*b* in turn pull the lower support arms 208*a*, 208*b* upwardly, until the wing members 202, 204 are in their fully raised position P6.

In one implementation, the upper support arm 206*a* and the lower support arm 208*a* are independently rotatable about a common axis. Similarly, the upper support arm 206*b* and the lower support arm 208*b* are independently rotatable about another common axis. In one embodiment, the axis about which the upper support arms 206*a*, 206*b* and/or lower support arms 208*a*, 208*b* rotate is substantially perpendicular to the longitudinal axis X1 of the torso 104 when the wing assembly 200 is coupled to the torso 104.

In one embodiment, the wing assembly 200 is detachably coupled to the torso 104, as shown in FIG. 9. The support member 212 may include an engagement member 216, such as an opening or recess, which cooperates with another engagement member 218, such as a projection or post, disposed on the back portion 120 of the torso 104 for releasably attaching the wing assembly 200 thereto. Thus, the wing assembly 200 may be coupled to the body 102 of the doll 100 to provide a first play mode, and the wing assembly 200 may be de-coupled from the body 102 of the doll 100 to provide another play mode.

Figure 10:
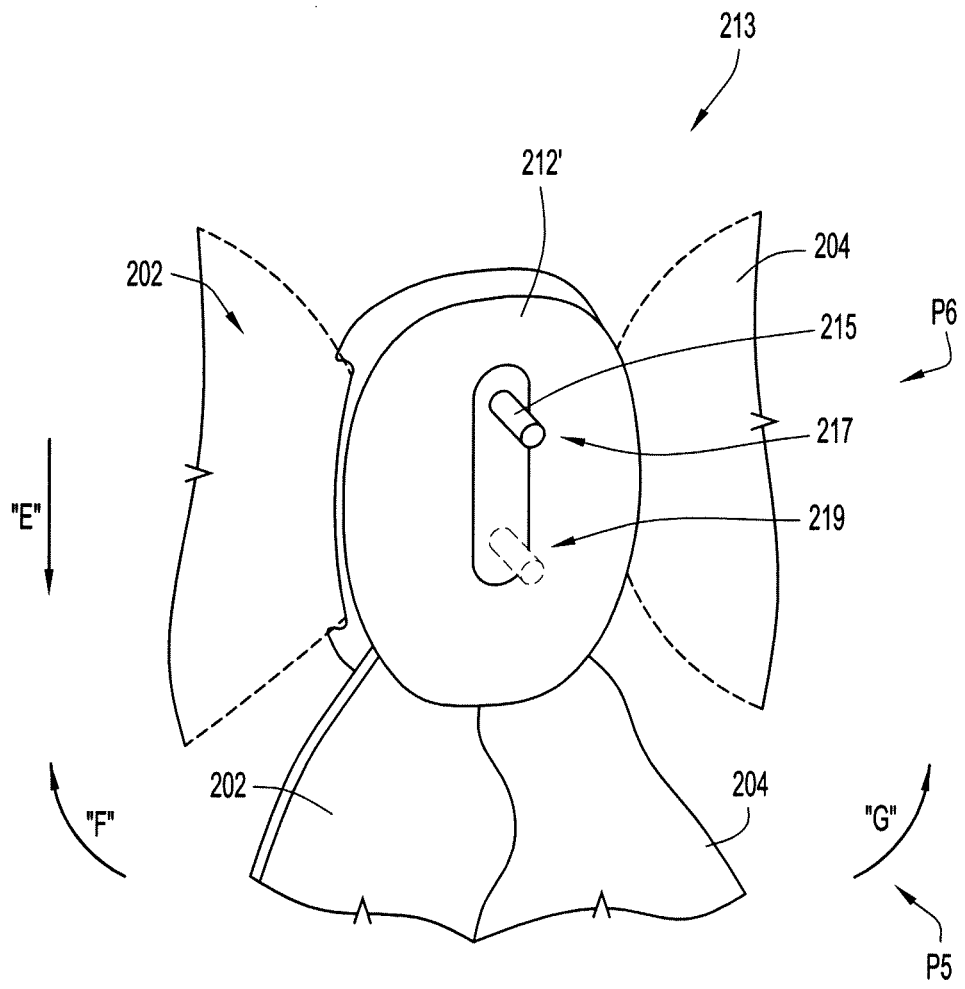
FIG. 10 illustrates a close-up perspective view of a portion of the wing assembly of the reconfigurable doll of FIG. 2.

Referring to FIG. 10, an embodiment of a wing actuator assembly 213 is illustrated. In this embodiment, actuator assembly 213 includes a support member 212' that can be coupled to the body of a doll. In this embodiment, the wing portions 202 and 204 are movable between positions P5 and positions P6, as described above. The support member 212' includes a switch or lever 215 that can be moved between positions 217 and 219 to change the position and configuration of the wing portions or members 202 and 204. When the lever 215 is moved along the direction of arrow "E," the wing portions 202 and 204 move along the direction of arrows "F" and "G," respectively. The lever 215 can be moved in the opposite direction to move the wing portions 202 and 204 from their raised positions to their lowered positions.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

For example, the garment member 128 of doll 100 is configured as a dress. However, other garment members may be employed, such as pants or sleeves of a shirt, which are retracted toward the torso portion of the doll and/or within a cavity defined by the torso. Alternatively, a garment member or other accessory including telescoping, sliding or folding plates may be utilized, which is retractable toward and/or within the torso.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A reconfigurable doll, comprising:

a body including a torso defining a cavity;

a first garment member coupled to the body, the first garment member movable between an extended position extending outwardly from the torso, and a retracted position substantially disposed within the cavity; and a second garment member coupled to the body, the second garment member being substantially covered by the first garment member when the first garment member is in its extended position, and the second garment member being exposed when the first garment member is in its retracted position.

2. The reconfigurable doll of claim 1, wherein the first garment member has a first length in the extended position and a second length in the retracted position, the second length being less than the first length.

3. The reconfigurable doll of claim 1, wherein the torso has a longitudinal axis and the first garment member is linearly movable in opposing first and second directions, the opposing first and second directions substantially parallel to the longitudinal axis of the torso.

4. The reconfigurable doll of claim 1, further comprising:

a wing assembly coupled to the torso, the wing assembly being movable between a raised position and a lowered position relative to the torso.

5. The reconfigurable doll of claim 4, wherein the first garment member is configured as a portion of a dress when the first garment member disposed in its extended position and the wing assembly is configured as a dress train when the wing assembly is disposed in its lowered position.

6. The reconfigurable doll of claim 4, wherein the wing assembly includes a first wing member and a second wing member, the first and second wing members are configured to simulate a pair of wings when the wing assembly is disposed in the raised position, and the first and second wing members are configured to simulate a dress train when the wing assembly is disposed in the lowered position.

7. The reconfigurable doll of claim 1, wherein the torso includes an opening, the doll further comprising:

an elongate member having a first end portion connected to the first garment member and a second end portion extending through the opening in the torso, the second end portion being movable away from the opening to move the first garment member from its extended position to its retracted position.

8. A reconfigurable doll, comprising:

a body including a torso; and a garment member coupled to the body, the garment member having a distal portion, the distal portion being movable between a retracted position proximate the torso and an extended position spaced from the torso; and a movement member coupled to the body, the movement member being movable between a raised position and a lowered position relative to the torso, the movement member forming a wing structure in the raised position, and the movement member forming a dress train in the lowered position.

9. The reconfigurable doll of claim 8, further comprising:

an actuator coupled to the body, the actuator being connected to the movement member and being manipulatable by a user to move the movement member between its raised position and its lowered position.

10. The reconfigurable doll of claim 8, wherein the torso defines a cavity, and at least a portion of the garment member is disposed within the cavity when the garment member is in its retracted position.

11. The reconfigurable doll of claim 8, wherein the garment member has a first length in the extended position and a second length in the retracted position, the second length being less than the first length.

12. The reconfigurable doll of claim 8, wherein the garment member is a first garment member, the doll further comprising:

a second garment member coupled to the body, the second garment member being substantially covered by the first garment member when the first garment member is in its extended position, and the second garment member being exposed when the first garment member is in its retracted position.

13. The reconfigurable doll of claim 8, wherein the garment member is linearly movable in opposing first and second directions, the opposing first and second directions being substantially parallel to a longitudinal axis of the torso.

14. The reconfigurable doll of claim 13, wherein the movement member includes a wing member, the wing member being pivotal about an axis substantially perpendicular to the first and second directions.

15. The reconfigurable doll of claim 8, wherein the torso includes an opening, the doll further comprising:

an elongate member having a first end portion connected to the garment member and second end portion extending through the opening in the torso, the second end portion being movable away from the opening to move the garment member from its extended position to its retracted position.

16. The reconfigurable doll of claim 8, wherein the movement member is detachably coupled to the body.

17. A reconfigurable doll comprising: a body including a torso defining a cavity, a first opening disposed in the torso and in communication with the cavity, and a second opening disposed in the torso and in communication with the cavity; a garment member coupled to the body and extending outwardly from the first opening; an extension member having a first end portion coupled to the garment member and an opposing second end portion extending outwardly from the second opening, at least a portion of the garment member being retractable into the cavity through the first opening as the second end portion of the extension member is moved away from the second opening in the torso, the garment member having a retracted position in which the garment member is substantially disposed within the cavity; and a wing assembly coupled to the torso, the wing assembly being movable between a raised position and a lowered position relative to the torso, wherein the garment member is configured as a portion of a dress when the garment member disposed in its extended position and the wing assembly is configured as a dress train when the wing assembly is disposed in its lowered position.

18. A reconfigurable doll comprising: a body including a torso defining a cavity, a first opening disposed in the torso and in communication with the cavity, and a second opening disposed in the torso and in communication with the cavity; a garment member coupled to the body and extending outwardly from the first opening; an extension member having a first end portion coupled to the garment member and an opposing second end portion extending outwardly from the second opening, at least a portion of the garment member being retractable into the cavity through the first opening as the second end portion of the extension member is moved away from the second opening in the torso, the garment member having a retracted position in which the garment member is substantially disposed within the cavity; and a wing assembly coupled to the torso, the wing assembly being movable between a raised position and a lowered position relative to the torso, wherein the wing assembly includes a first wing member and a second wing member, the first and second wing members are configured to simulate a pair of wings when the wing assembly is disposed in the raised position, and the first and second wing members are configured to simulate a dress train when the wing assembly is disposed in the lowered position.

* * * * *